US010073380B2

(12) United States Patent
Nosho et al.

(10) Patent No.: US 10,073,380 B2
(45) Date of Patent: Sep. 11, 2018

(54) FEEDING DEVICE

(71) Applicant: CANON KABUSHIKI KAISHA, Tokyo (JP)

(72) Inventors: Hiroaki Nosho, Suntou-gun (JP); Takatoshi Hamada, Mishima (JP); Noriyuki Komatsu, Numazu (JP); Ryuta Murakami, Suntou-gun (JP); Naoki Matsumaru, Suntou-gun (JP); Naoki Maeda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/288,024

(22) Filed: Oct. 7, 2016

(65) Prior Publication Data

US 2017/0108801 A1 Apr. 20, 2017

(30) Foreign Application Priority Data

Oct. 14, 2015 (JP) ..... 2015-202503

(51) Int. Cl.
*G03G 15/08* (2006.01)

(52) U.S. Cl.
CPC ..... *G03G 15/0887* (2013.01)

(58) Field of Classification Search
None
See application file for complete search history.

(56) References Cited

U.S. PATENT DOCUMENTS

| | | | | |
|---|---|---|---|---|
| 2007/0242993 | A1 | 10/2007 | Tanaka | |
| 2014/0105649 | A1 | 4/2014 | Ota | |
| 2016/0154341 | A1* | 6/2016 | Hamada | G03G 15/0891 399/358 |

FOREIGN PATENT DOCUMENTS

| | | | |
|---|---|---|---|
| JP | H09-319222 | A | 12/1997 |
| JP | 2003-107828 | A | 4/2003 |
| JP | 2006-133465 | A | 5/2006 |
| JP | 2011-186213 | A | 9/2011 |

OTHER PUBLICATIONS

European Search Report dated Mar. 20, 2017, in related European Patent Application No. 16193454.2.
Ryuta Murakami et al., U.S. Appl. No. 15/288,096, filed Oct. 7, 2016.
Naoki Maeda et al., U.S. Appl. No. 15/288,038, filed Oct. 7, 2016.

* cited by examiner

*Primary Examiner* — Thomas Giampaolo, II
(74) *Attorney, Agent, or Firm* — Fitzpatrick, Cella, Harper & Scinto

(57) ABSTRACT

A feeding device for feeding developer includes a first feeding member for feeding the developer in a feeding direction and including a drive transmitting portion, and a second feeding member including a drive receiving portion and a helical blade as a feeding portion. In addition, a bearing portion rotatably supports the second feeding member in a portion between the drive receiving portion and the helical blade, wherein the drive transmitting portion and the drive receiving portion engage with each other so as to enable delivery of the developer from the first feeding member to the second feeding member while transmitting a driving force of the first feeding member to the second feeding member. The bearing portion is provided on one side of a second rotational axis of the second feeding member with respect to the feeding direction.

21 Claims, 13 Drawing Sheets

(a)

(b)

(a)

(b)

(a)

(b)

FEEDING DEVICE

FIELD OF THE INVENTION AND RELATED ART

The present invention relates to a feeding device, for feeding a developer, and is suitable for an electrophotographic image forming apparatus for forming an image on a recording material (medium) by using an electrophotographic image forming process. Examples of the electrophotographic image forming apparatus may include an electrophotographic copying machine, an electrophotographic printer (LED printer, laser beam printer or the like), a facsimile machine and a word processor, etc., for example.

Here, the feeding device is a device for feeding a developer for use with the image forming apparatus to a predetermined place. For example, it is possible to cite a device for feeding a residual developer, remaining on a photosensitive drum after transfer, to a residual developer accommodating chamber.

In the electrophotographic image forming apparatus, in general, a drum-shaped electrophotographic photosensitive member, i.e., a photosensitive drum as an image bearing member is electrically charged uniformly. Then, the charged photosensitive drum is selectively exposed to light, so that an electrostatic latent image is formed on the photosensitive drum. Then, the electrostatic latent image formed on the photosensitive drum is developed as a toner image with a toner as a developer. Then, the toner image formed on the photosensitive drum is transferred onto the recording material such as a recording sheet or a plastic sheet, and then the toner image transferred on the recording material is subjected to application of heat and pressure and thus is fixed on the recording material to effect image recording.

Such an image forming apparatus requires toner supply and maintenance of various process means in general. In order to facilitate the toner supply and the maintenance, a process cartridge in which the photosensitive drum, the charging means, the developing means, the cleaning means and the like are integrally assembled into a cartridge in a single frame is made detachably mountable to an image forming apparatus main assembly and has been put into practical use.

According to this process cartridge type, the maintenance of the devices can be made by a user himself (herself), and therefore operativity can be remarkably improved, so that it is possible to provide an image forming apparatus excellent in usability. For that reason, the process cartridge type has been widely used in the image forming apparatus.

In such a process cartridge, there arises a need to feed the toner as the developer to a distant position in some cases. Therefore, in order to feed the toner to the distant position, a plurality of feeding members are drive-connected with each other, so that drive transmission and delivery of the toner are effected simultaneously. Such a constitution has been disclosed (Japanese Laid-Open Patent Application (JP-A) 2003-107828).

However, when the plurality of feeding member are drive-connected with each other and are disposed as disclosed in JP-A 2003-107828, in order to effect drive transmission with reliability, it is desirable that a bearing is provided at a position close to a drive transmitting portion for the purpose of supporting the feeding member with reliability. In the case where, the bearing was provided at the position close to the drive transmitting portion, there was a possibility that feeding of the developer was prevented by the bearing itself.

SUMMARY OF THE INVENTION

A principal object of the present invention is to provide a feeding device improved in developer feeding property by suppressing a degree of impairment of feeding of a developer by a bearing itself.

According to an aspect of the present invention, there is provided a feeding device for feeding a developer along a first feeding path and a second feeding path, comprising: a first feeding member for feeding the developer in a feeding direction along a first rotational axis direction, the first feeding member being provided in the first feeding path and including a driving shaft and a drive transmitting portion; and a second feeding member for feeding the developer along a second rotational axis direction crossing the first rotational axis direction, with the second feeding member being provided in the second feeding path and including a driven shaft and a drive receiving portion, wherein the drive transmitting portion and the drive receiving portion engage with each other so as to enable delivery of the developer from the first feeding member to the second feeding member while transmitting a driving force of the first feeding member to the second feeding member, and wherein a bearing portion for rotatably supporting the second feeding member is provided in an upstream side with respect to the feeding direction.

Further features of the present invention will become apparent from the following description of exemplary embodiments with reference to the attached drawings.

DESCRIPTION OF THE EMBODIMENTS

Embodiments of the present invention will be described in detail with reference to the drawings. In the following description, a rotational axis direction of a photosensitive drum is a longitudinal direction. Further, with respect to the longitudinal direction, a side in which the photosensitive drum receives a driving force from an apparatus main assembly of an image forming apparatus is a driving side, and an opposite side thereof is a non-driving side.

First Embodiment (General Structure of Image Forming Apparatus)

Figure 2:
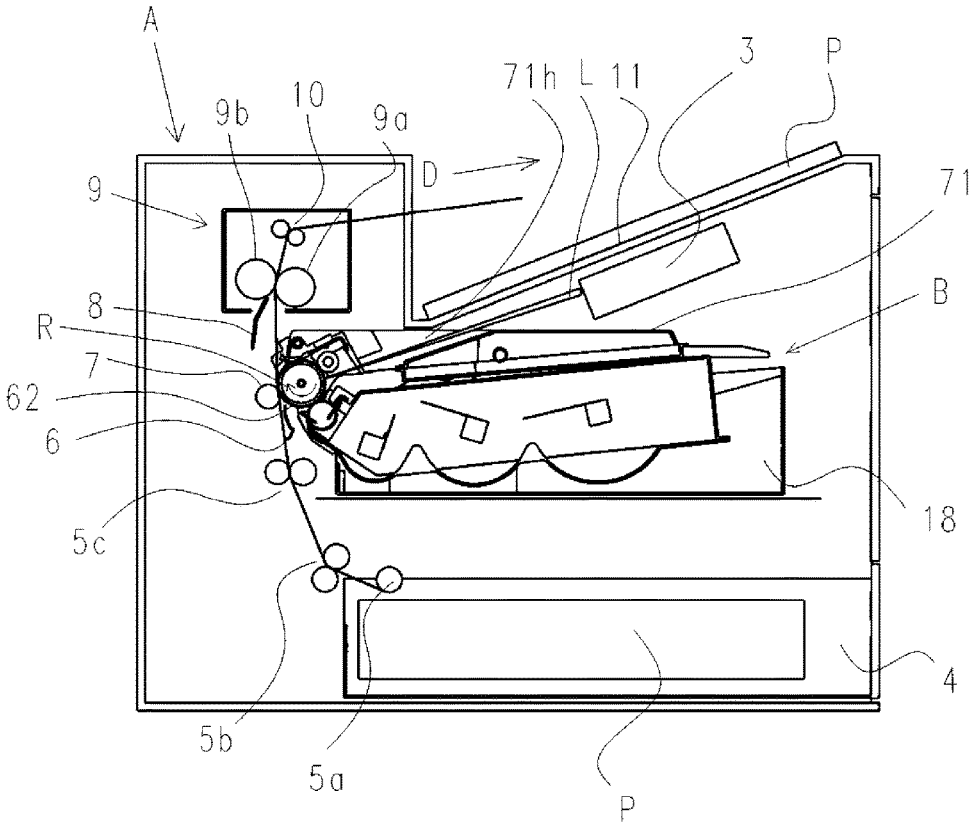
FIG. 2 is a sectional view showing a main assembly of an image forming apparatus in which the feeding device in the First Embodiment is mounted and showing a process cartridge.

FIG. 2 is a sectional view showing a main assembly of an image forming apparatus 1 (hereinafter referred to as an apparatus main assembly A) in which a feeding device according to this embodiment is mounted and showing a process cartridge (hereinafter referred to as a cartridge B. The apparatus main assembly A is a portion from which the cartridge B is removed. Further, the process cartridge described as the cartridge B is a cartridge including at least an image bearing member such as an electrophotographic photosensitive drum, and is a cartridge integrally including the image bearing member and a process means actable on the image bearing member. Such a process cartridge is detachably mountable to an apparatus main assembly of the image forming apparatus.

As the process cartridge described as the cartridge B, it is possible to cite a process cartridge prepared by integrally assembling, for example, the electrophotographic photosensitive drum and, as the process means, at least one of a developing means, a charging means and a cleaning means into a cartridge (unit).

The image forming apparatus shown in FIG. 2 is a laser beam printer using electrophotography in which the cartridge B is detachably mountable to the apparatus main assembly A. When the cartridge B is mounted in the apparatus main assembly A, an exposure device (laser scanner unit) 3 for forming an electrostatic latent image on an electrophotographic photosensitive drum (hereinafter referred to as a drum) 62 of the cartridge B is provided. Further, below the cartridge B, a sheet (feeding) tray 4 in which a recording material or medium (hereinafter referred to as a sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

(Image Forming Process)

Figure 3:
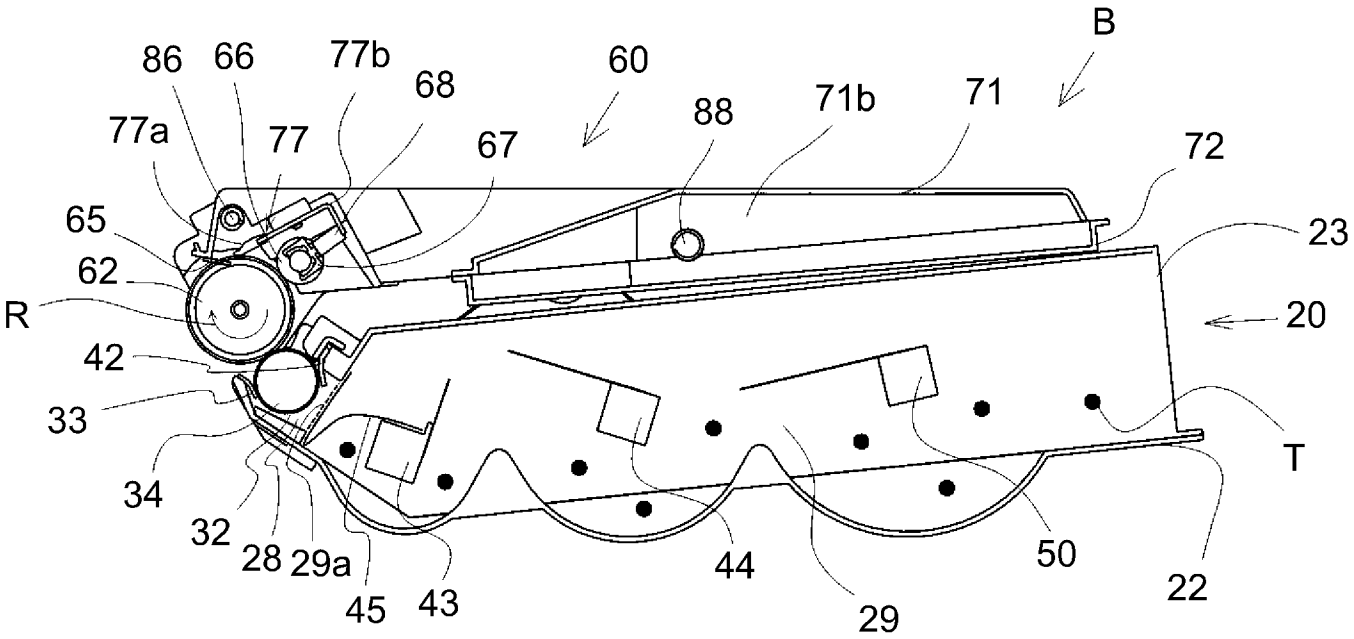
FIG. 3 is a sectional view of the process cartridge in which the feeding device in the First Embodiment is mounted.

An outline of an image forming process will be described using FIGS. 2 and 3. FIG. 3 is a sectional view of the cartridge B.

As shown in FIG. 2, on the basis of a print start signal, the drum 62 is rotationally driven at a predetermined peripheral speed (process speed) in an arrow R direction. Then, as shown in FIG. 3, a charging roller 66 to which a bias voltage is applied contacts the outer peripheral surface of the drum 62 and electrically charges the outer peripheral surface of the drum 62 uniformly.

The exposure device 3 outputs laser light L depending on image information as shown in FIG. 2. The laser light L passes through a laser opening 71*h* provided in a cleaning frame 71, so that the outer peripheral surface of the drum 62 is subjected to scanning exposure. As a result, on the outer peripheral surface of the drum 62, the electrostatic latent image depending on the image information is formed.

On the other hand, in FIG. 3, a toner T in a toner chamber 29 (developing chamber), for accommodating the developer for image formation, provided in a developing unit 20 as a developing device is stirred and fed by rotation of a first stirring member 43, a second stirring member 44 and a third stirring member 50, thus being sent to a toner supplying chamber 28. The toner T is carried by a magnetic force of a magnet roller 34 (fixed magnet) on a surface of a developing roller 32 as a developer carrying member opposing the drum 62. The toner T is regulated in layer thickness on the peripheral surface of the developing roller 32 by a developing blade 42 as a collecting member for collecting the developer while being triboelectrically charged. Thereafter, the toner T is supplied onto the drum 62 depending on the electrostatic latent image, so that the electrostatic latent image is visualized (developed) as a toner image.

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11 in an arrow D direction.

On the other hand, as shown in FIG. 3, from the drum 62 after the transfer, a residual toner remaining on the outer peripheral surface of the drum 62 is removed by a cleaning blade 77 as a collecting member for collecting the developer, and the drum 62 is used again in the image forming process. The residual toner removed from the drum 62 is stored in a residual toner chamber 71*b* as an accommodating portion of a cleaning unit 60.

In the above, the charging roller 66, the developing roller 32, the transfer roller 7 and the cleaning blade 77 are process means actable on the drum 62.

(Mounting and Demounting of Cartridge Relative to Apparatus Main Assembly)

Figure 4:
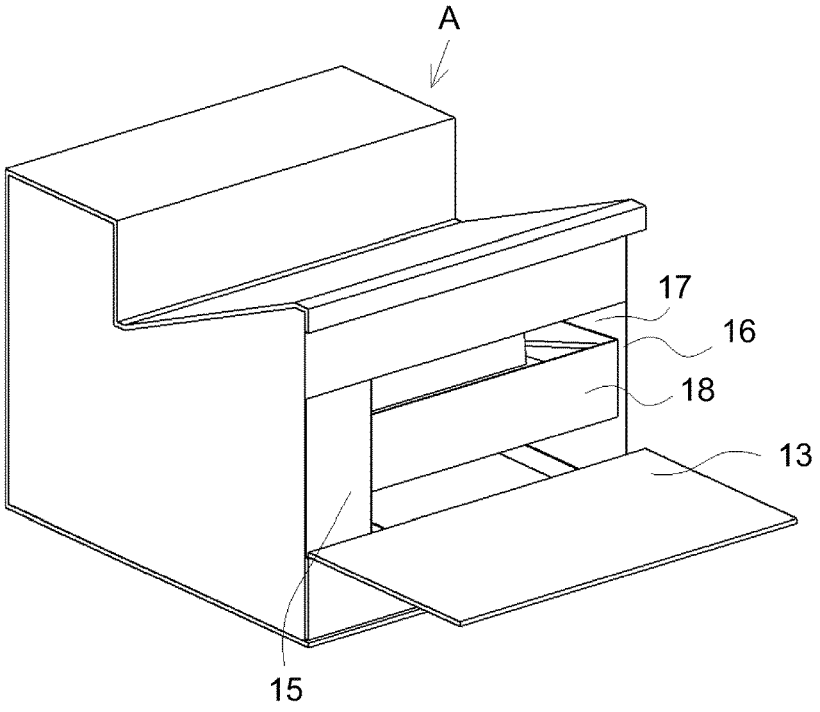
FIG. 4 is a perspective view of the image forming apparatus main assembly in a state in which an openable door of the image forming apparatus in which the feeding device in the First Embodiment is mounted is open.
Figure 5:
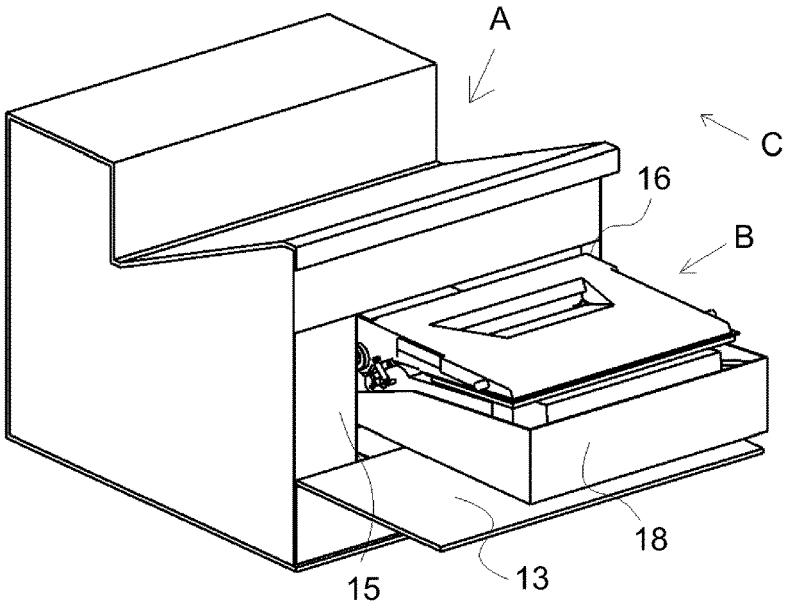
FIG. 5 is a perspective view of the image forming apparatus main assembly in a state in which the openable door of the image forming apparatus in which the feeding device in the First Embodiment is mounted is opened and then a tray is pulled out.
Figure 6:
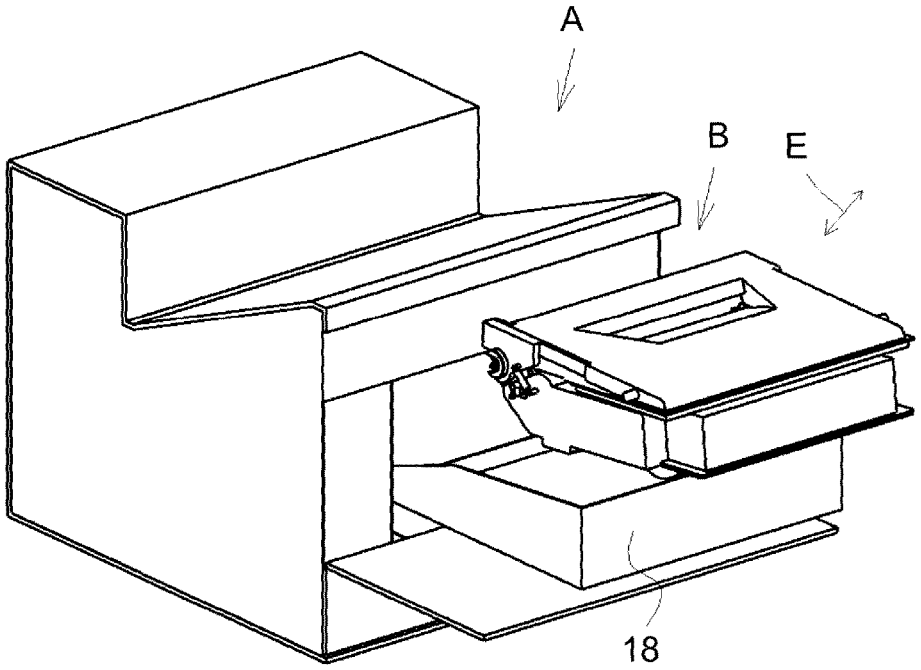
FIG. 6 is a perspective view of the image forming apparatus main assembly and the process cartridge when the process cartridge is mounted in and demounted from the tray in the state in which the openable door of the image forming apparatus in which the feeding device in the First Embodiment is mounted is opened and then the tray is pulled out.
Figure 7:
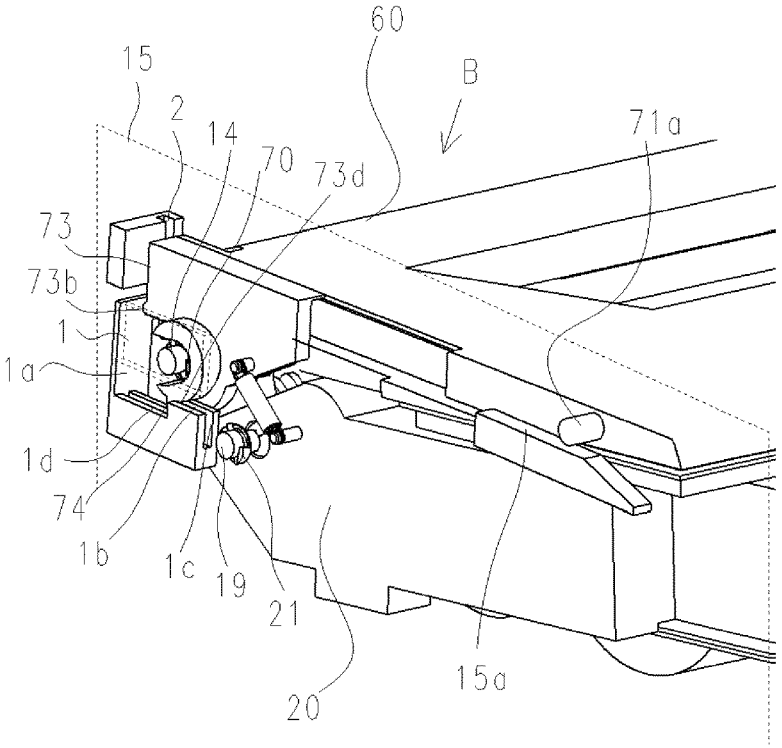
FIG. 7 is a perspective view showing a driving side positioning portion between the process cartridge and the image forming apparatus main assembly in a state that the process cartridge in which the feeding device in the First Embodiment is mounted is mounted in the image forming apparatus main assembly.

Next, mounting and demounting of the cartridge B will be described using FIGS. 4 to 7. FIG. 4 is a perspective view of the apparatus main assembly A of which an openable door 13 is opened for permitting mounting and demounting of the cartridge B. FIG. 5 is a perspective view of the apparatus main assembly A and the cartridge B in a state in which the openable door 13 is opened for permitting the mounting and demounting of the cartridge B and then a tray 18 is pulled out. FIG. 6 is a perspective view of the apparatus main assembly A and the cartridge B when the cartridge B is mounted and demounted in the state in which the openable door 13 is opened and then the tray 18 is pulled out. FIG. 7 is a perspective view of a driving side positioning portion between the cartridge B and the apparatus main assembly A in a state in which the cartridge B is mounted in the apparatus main assembly A.

As shown in FIG. 4, to the apparatus main assembly A, the openable door 13 is rotatably attached, and when the openable door 13 is opened, a cartridge inserting opening 17 is exposed. In the cartridge inserting opening 17, a tray 18 for mounting the cartridge B in the apparatus main assembly A is provided. As shown in FIG. 6, when the tray 18 is pulled out to a predetermined position, the cartridge B can be mounted and demounted. The cartridge B is inserted (mounted) in the apparatus main assembly A along a guide rail (not shown) in an arrow C direction in FIG. 6 in a state in which the cartridge B is placed on the tray 18. The mounting and demounting of the cartridge B relative to the tray 18 are made along an arrow E direction in FIG. 6.

The apparatus main assembly A is provided with a first driving shaft 14 and a second driving shaft 19 as shown in FIG. 7. The first driving shaft 14 transmits a driving force to a first coupling 70 of the cartridge B. The second driving shaft 19 transmits a driving force to a second coupling 21. The first driving shaft 14 and the second driving shaft 19 are driven by a motor (not shown) of the apparatus main assembly A. As a result, the drum 62 connecting with the first coupling 70 receives the driving force from the apparatus main assembly A and is rotated.

The developing roller 32 is rotated by transmission of the driving force from the second coupling 21. Further, to the charging roller 66 and the developing roller 32, a predetermined bias voltage is applied by an electric power supplying portion (not shown) of the apparatus main assembly A.

(Cartridge Supporting Structure of Apparatus Main Assembly)

Figure 8:
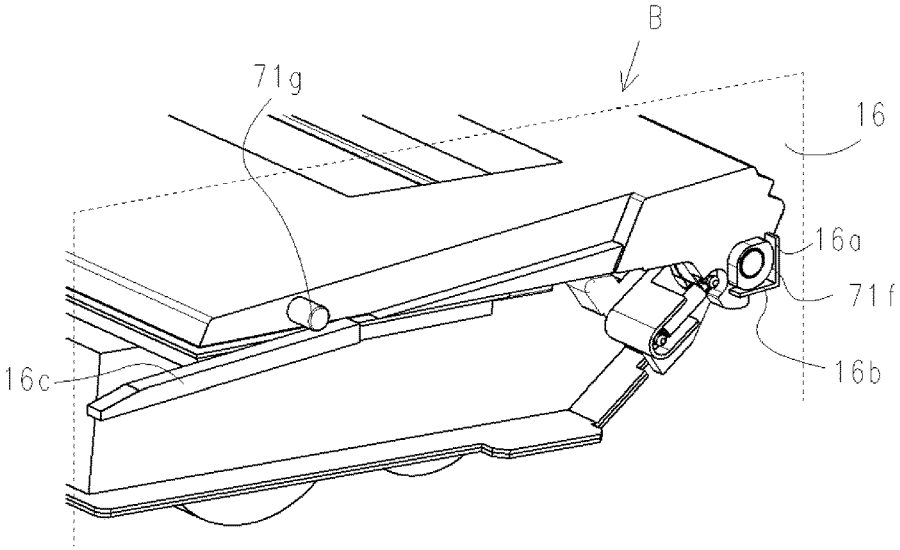
FIG. 8 is a perspective view showing a non-driving side positioning portion between the process cartridge and the image forming apparatus main assembly in the state that the process cartridge in which the feeding device in the First Embodiment is mounted is mounted in the image forming apparatus main assembly.

Next, a supporting structure of the cartridge B by the apparatus main assembly A will be described using FIGS. 2, 4, 7 and 8. As shown in FIG. 4, the apparatus main assembly A is provided with a driving side-side plate 15 and the non-driving side-side plate 16 for supporting the cartridge B. As shown in FIG. 7, the driving side-side plate 15 is provided with a driving side-first supporting portion 15*a*, a driving side-second supporting portion 15*b* and a rotation supporting portion 15*c* for the cartridge B. As shown in FIG. 8, the non-driving side-side plate 16 is provided with a non-driving side-first supporting portion 16*a*, a non-driving side-second supporting portion 16*b* and a rotation supporting portion 16*c* for the cartridge B.

On the other hand, as driving side portions-to-be-supported of the cartridge B, a portion-to-be-supported 73*b* and a portion-to-be-supported 73*d* of a drum bearing 73, and a driving side boss 71*a* of the cleaning frame 71 are provided as shown in FIG. 7. Further, a non-driving side projection 71*f* and a non-driving side boss 71*g* are provided as shown in FIG. 8. The portion-to-be-supported 73*b* is supported by the driving side-first supporting portion 15*a*, the portion-to-be-supported 73*d* is supported by the driving side-second supporting portion 15*b*, and the driving side boss 71*a* is supported by the rotation supporting portion 15*c*. The non-driving side projection 71*f* is supported by the non-driving side-first supporting portion 16*a* and the non-driving side-second supporting portion 16*b*, and the non-driving side boss 71*g* is supported by the rotation supporting portion 16*c*.

Further, as shown in FIG. 7, a portion-to-be-regulated (not shown) provided on the drum bearing 73 engages with a regulating portion 2 provided in the apparatus main assembly A, so that a position of the cartridge B with respect to the drum axis direction is determined, and thus the cartridge B is positioned in the apparatus main assembly A.

(General Structure of Cartridge)

A general structure of the cartridge B will be described with reference to FIGS. 3, 9, 10, 11, 12 and 13. FIG. 3 is a sectional view of the cartridge B. FIGS. 10-13 are perspective views for illustrating a structure of the cartridge B. FIGS. 10 and 13 are partially enlarged views showing dotted-circle portions of FIGS. 10 and 12, respectively, with a different angle. In this embodiment, screws used during connection of respective parts will be omitted from description.

As shown in FIG. 3, the cartridge B in this embodiment includes the cleaning unit 60 as a developer feeding unit for feeding the developer and includes the developing unit 20. In this embodiment, the process cartridge in which the cleaning unit 60 and the developing unit 20 are connected with each other will be described. However, the present invention is not limited thereto, but may also be applicable to a cleaning unit 60 consisting of a cleaning device alone or a developing unit consisting of a feeding device alone.

As shown in FIG. 3, the cleaning unit 60 includes the drum 62, the charging roller 66, the cleaning member 77, the cleaning frame 71 and a cover member 72 fixed to the cleaning frame 71 by welding or the like. In the cleaning unit 60, each of the charging roller 66 and the cleaning member 77 is disposed in contact with the outer peripheral surface of the drum 62.

The cleaning member 77 in this embodiment includes a rubber blade 77*a* which is a blade-shaped elastic member formed of a rubber as an elastic material, and includes a supporting member 77*b* for supporting the rubber blade 77*a*. The rubber blade 77*a* contacts the drum 62 counterdirectionally to a rotational direction of the drum 62. That is, the rubber blade 77*a* contacts the drum 62 so that a free end portion thereof faces toward an upstream side with respect to the rotational direction of the drum 62. In this embodiment, the cleaning member was described using the cleaning blade, but is not limited thereto. It is also possible to use a roller-shaped cleaning member.

Figure 9:
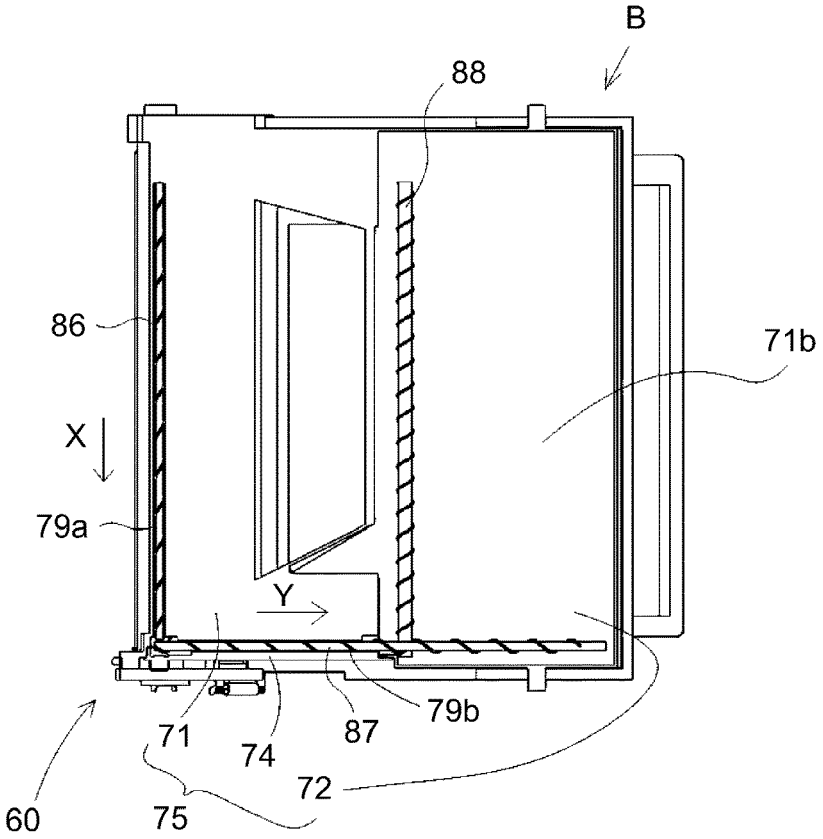
In FIG. 9, (a) and (b) are schematic views each showing an inside of a cleaning container of the process cartridge in which the feeding device in the First Embodiment is mounted.
Figure 9:
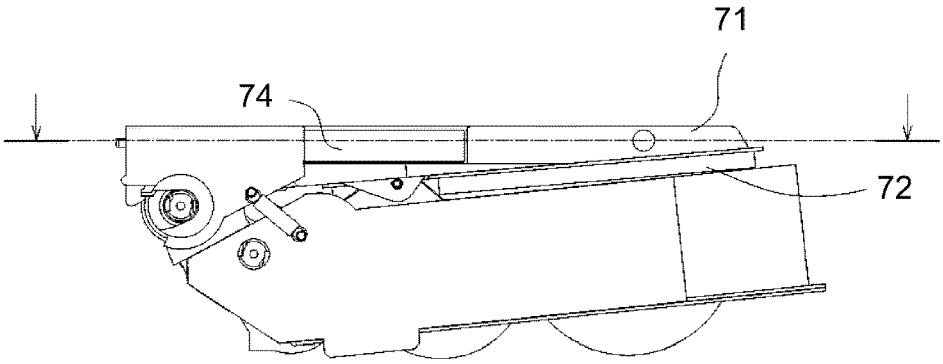
Figure 10:
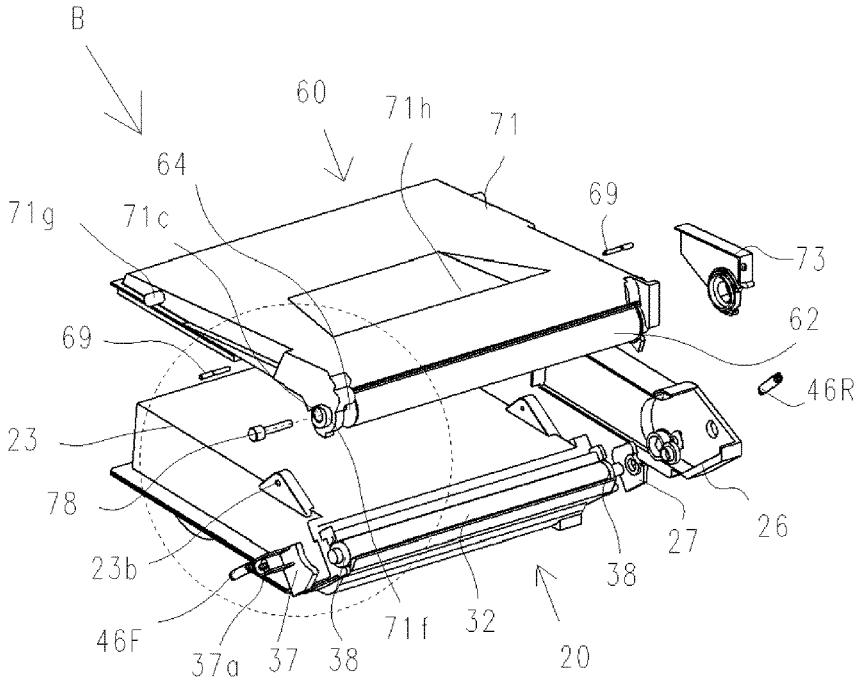
FIG. 10 is an exploded view of the process cartridge in which the feeding device in the First Embodiment is mounted as seen from a non-driving side.

In FIG. 9, (a) is a sectional view of the cleaning unit 60. As shown in FIGS. 3 and 9, a residual developer (hereinafter referred to as a residual toner) removed from the surface of the drum 62 by the cleaning member 77 is fed by the feeding member. The feeding member includes at least a shaft and a feeding portion for feeding the toner.

In this embodiment, the case where the feeding member is a screw will be described. As shown in FIG. 9, the cleaning unit 60 includes a first screw 86, a second screw 87, a third screw 88, the cleaning frame 71, a screw cover 74 and the cover member 72. A residual toner accommodating container 75 as a developer accommodating container is prepared by connecting the cleaning frame 71, the screw cover 74 and the cover member 72, and accommodates the residual toner.

After the first screw 86 as a first feeding member feeds the toner (developer) in an arrow X direction, the second screw 87 as a second feeding member feeds the toner in an arrow Y direction. Thereafter, the toner is accumulated in the residual toner chamber 71*b* by the third screw 88 as a third feeding member provided inside the residual toner chamber 71*b* formed by the cleaning frame 71 and the screw cover 74.

In this embodiment, rotational axes of the first screw 86 and the third screw 88 are parallel to a rotational axis of the drum 62, and a rotational axis of the second screw 87 is perpendicular to the rotational axis of the drum 62. However, even when such a positional relationship is not established, it is only required that a driving force can be transmitted and the toner can be fed. For example, the axes of the first screw 86 and the second screw 87 may only be required to cross each other, so that a constitution in which the rotational axis of the second screw 87 is inclined from a longitudinal end portion of the cartridge B toward an inside may also be employed. Further, also the axes of the first screw 86 and the third screw 88 may also cross each other, not in parallel to each other.

As described later specifically, the screw which is the feeding member is provided with a feeding portion for feeding the toner (developer). The developer feeding portion may only be required to feed the residual toner and may also be provided with a helical projected portion or a plurality of twisted blade-shaped portions. Further, the feeding member is not limited to the screw but may only be required to employ a constitution capable of feeding the residual toner in the axial direction thereof. For example, the residual toner may also be fed by a coil or the like.

Further, as shown in FIG. 3, a drum contact sheet 65 for preventing the residual toner from leaking out of the cleaning frame 71 is provided at an end portion of the cleaning frame 71 so as to contact the drum 62. The drum 62 is rotationally driven in the arrow R direction in FIG. 3 depending on an image forming operation by receiving the driving force from a main assembly driving motor (not shown) which is a driving source.

The charging roller 66 is rotatably mounted to the cleaning unit 60 via charging roller bearings 67 at end portions thereof with respect to a longitudinal direction of the cleaning frame 71 (substantially parallel to a rotational axis direction of the drum 62). The charging roller 66 is press-contacted to the drum 62 by pressing the charging roller bearings 67 toward the drum 62 by urging members 68. The charging roller 66 is rotated by rotation of the drum 62.

As shown in FIG. 3, the developing unit 20 includes the developing roller 32, a developing container 23 for supporting the developing roller 32, and the developing blade 42 and the like.

Inside the developing roller 32, a magnet roller 34 is provided. Further, in the developing unit 20, the developing blade 42 for regulating a toner layer (thickness) on the developing roller 32 is disposed.

Figure 12:
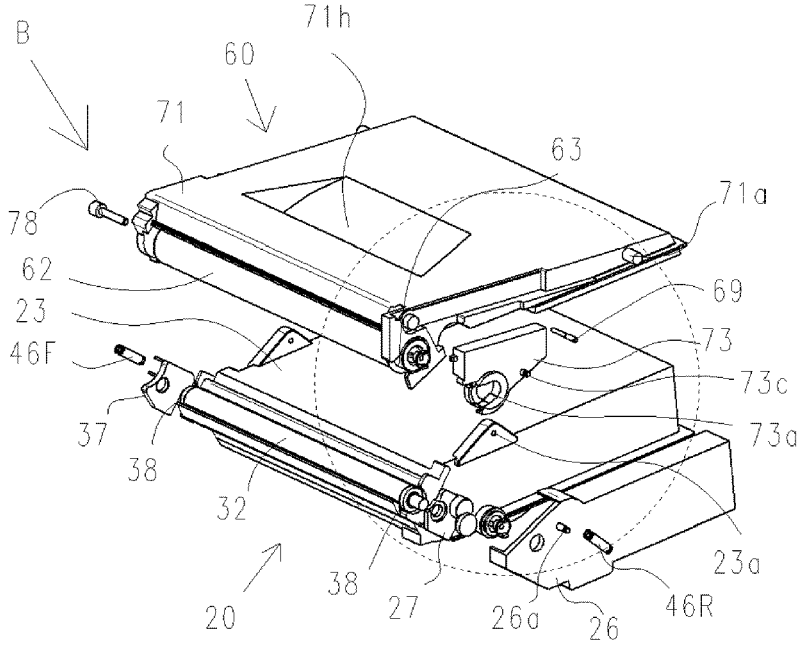
FIG. 12 is an exploded view of the process cartridge in which the feeding device in the First Embodiment is mounted as seen from a driving side.
Figure 13:
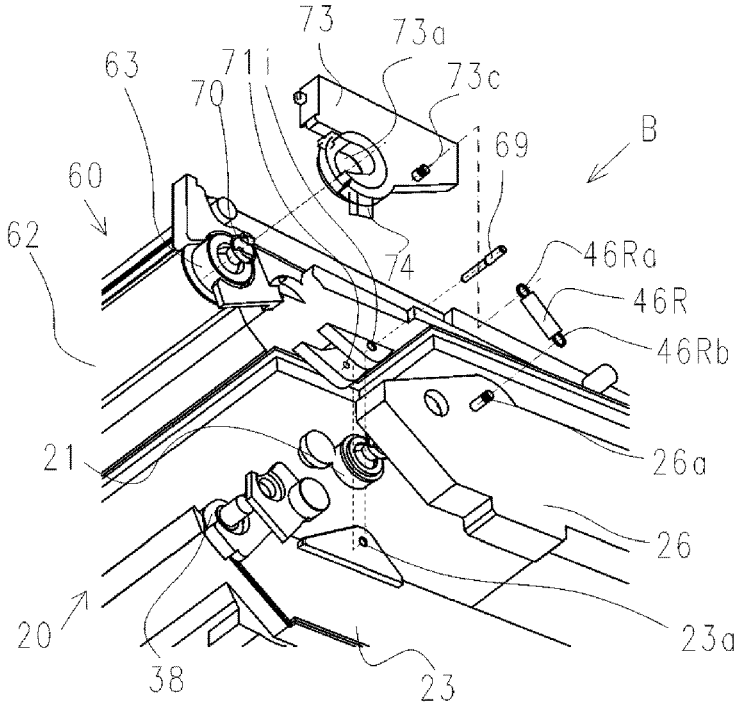
FIG. 13 is an exploded view of the process cartridge which includes a driving side urging member and in which the feeding device in the First Embodiment is mounted.

As shown in FIGS. 10 and 12, a gap-keeping member 38 is mounted to the developing roller 32 at each of end portions of the developing roller 32, and by contact of the gap-keeping members 38 with the drum 62, the developing roller 32 is held so as to have a predetermined gap with the drum 62. Further, as shown in FIG. 3, a developing roller contact sheet 33 for preventing leaking-out of the toner from the developing unit 20 is provided at an edge portion of the bottom member 22 so as to contact the developing roller 32.

In the toner chamber 29 formed by the developing container 23 and the bottom member 22, a first feeding member 43, a second feeding member 44 and a third feeding member 50 are provided. Each of the first feeding member 43, the second feeding member 44 and the third feeding member 50 not only stirs the toner accommodated in the toner chamber 29 but also feeds the toner to the toner supplying chamber 28.

In FIG. 3, between the toner chamber 29 and the toner supplying chamber 28, an opening 29*a* (indicated by a broken line) is provided, and this opening 29*a* is sealed (covered) with a sealing member 45 until the cartridge B is used. The sealing member 45 is a sheet-shaped member formed of polyethylene or the like, and is welded to the developing container 23 around the opening 29*a* in one end side thereof and is fixed to the first feeding member 43 in the other end side thereof. When the first feeding member 43 rotates at the time when the cartridge B is first used, the sheet member (sealing member) 45 is wound up by the first feeding member 43 while being peeled at a welding portion between itself and the developing container 23, so that the opening 29*a* is opened (exposed).

As shown in FIGS. 10 and 12, the cartridge B is constituted by connecting the cleaning unit 60 and the developing unit 20 with each other.

The cleaning unit 60 includes, and the cleaning frame 71, the screw cover 74, the drum 62, and the drum bearing 73 and a drum shaft 78 which are used for rotatably supporting the drum 62. As shown in FIG. 13, in the driving side, on the drum 62, a driving side drum flange 63 provided in the driving side is rotatably supported by a hole 73*a* of the drum bearing 3. In the non-driving side, as shown in FIG. 11, the drum shaft 78 press-fitted in a hole 71*c* provided in the cleaning frame 71 rotatably supports a hole (not shown) of a non-driving side drum flange 64.

On the other hand, as shown in FIGS. 3, 10 and 12, the developing unit 20 includes the bottom member 22, the developing container 23, the driving side-developing side member 26, the developing blade 42, the developing roller 32 and the like. Further, by bearing members 27 and 37 provided at end portions of the developing roller 32, the developing roller 32 is rotatably mounted to the developing container 23.

Figure 11:
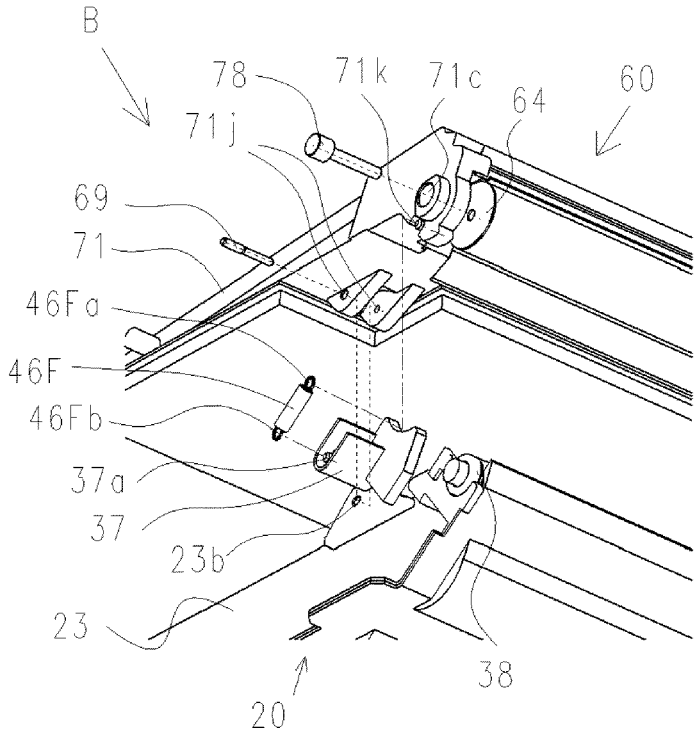
FIG. 11 is an exploded view of the process cartridge which includes a non-driving side urging member and in which the feeding device in the First Embodiment is mounted.

As shown in FIGS. 11 and 13, the cartridge B is constituted by rotatably connecting the cleaning unit 60 and the developing unit 20 by connecting pins 69 relative to each other. Specifically, a developing-first supporting hole 23*a* and a developing-second supporting hole 23*b* are provided in the developing container 23 at longitudinal end portions of the developing unit 20. Further, at longitudinal end portions of the cleaning unit 60, first hanging holes 71*i* and second hanging holes 71*j* are provided in the cleaning frame 71.

Then, by engagement of the connecting pins 69 press-fitted and fixed in the first hanging holes 71*i* and the second hanging holes 71*j* with the first supporting hole 23*a* and the second supporting hole 23*b*, the cleaning unit 60 and the developing unit 20 are rotatably connected with each other.

Further, a first hole 46Ra of a driving side-urging member 46R is hooked on a boss 73*c* of the drum bearing member 73, and a second hole 46Rb of the driving side-urging member 46R is hooked on a boss 26*a* of the driving side-developing side member 26. Further, a first hole 46Fa of a non-driving side-urging member 46F is hooked on a boss 71*k* of the cleaning frame 71, and a second hole 46Fb of the non-driving side-urging member 46F is hooked on a boss 37*a* of the bearing member 37.

In this embodiment, each of the driving side-urging member 46R and the non-driving side-urging member 46F is formed with a tension spring. Further, the developing unit 20 is urged toward the cleaning unit 60 by an urging force of these springs, so that the developing roller 32 is constituted so as to be pressed toward the drum 62 with reliability. Further, by the gap maintaining members 38 provided at the end portions of the developing roller 32, the developing roller 32 is held with a predetermined gap from the drum 62.

(Residual Toner Feeding By First Screw and Second Screw)

Figure 1:
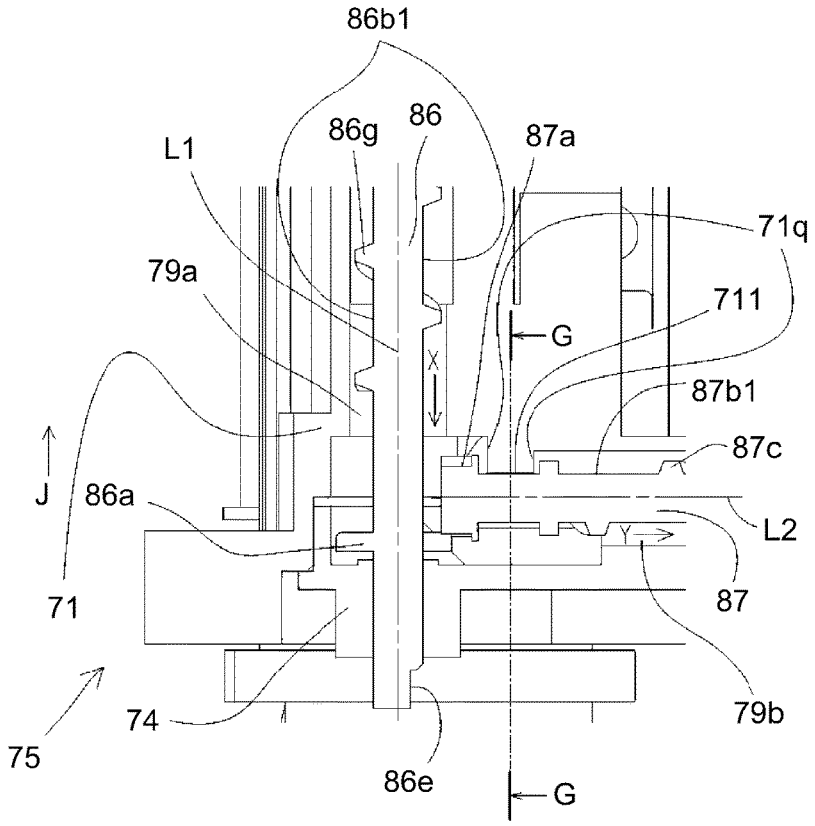
In FIG. 1, (a) is a sectional view of a first feeding path and a second feeding path of a feeding device according to a First Embodiment to which the present invention is applicable, and (b) is a sectional view of a second screw supporting means in the First Embodiment.
Figure 1:
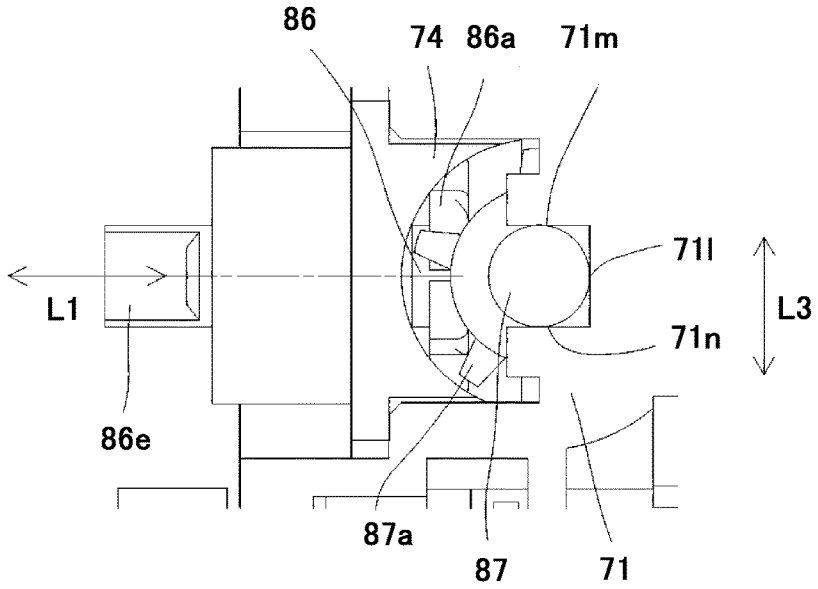
Figure 14:
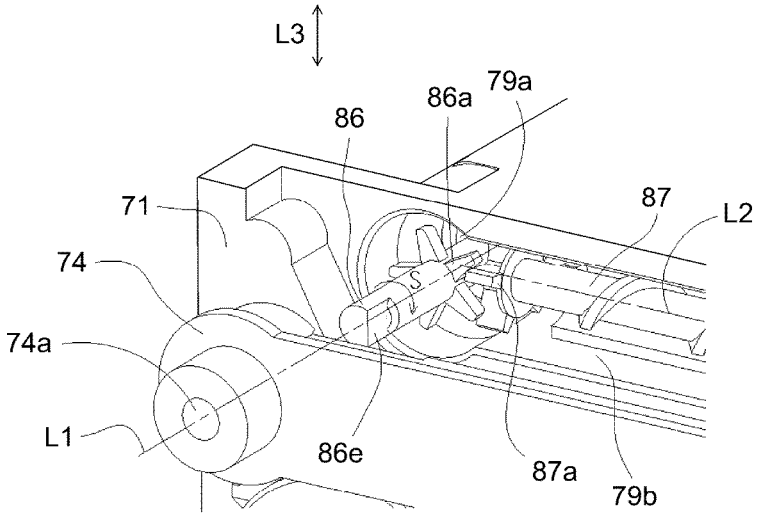
FIG. 14 is a perspective view of a drive-connecting portion between a first screw and the second screw in the feeding device in the First Embodiment.

A general structure of residual toner feeding by the first screw 86 and the second screw 87 will be described with reference to FIGS. 1, 14 and 15. In FIG. 1, (a) is a sectional view of a first feeding path 79*a* and a second feeding path 79*b*, and (b) is a sectional view of the residual toner accommodating container taken along G-G line of (a) of FIG. 1. FIG. 14 is a perspective view of a connecting portion between the first screw 86 and the second screw 87.

As shown in FIG. 14, the rotational axis of the first screw is a first axis is L1, the rotational axis of the second screw 87 is a second axis L2, and an axis perpendicular to each of the first axis L1 and the second axis L2 is L3. FIG. 15 is a schematic view of the connecting portion between the first screw 86 and the second screw 87 as seen in a direction of the first axis L1.

As shown in FIG. 1, in the residual toner accommodating container 75, the first feeding path 79*a* and the second feeding path 79*b* are provided. The first screw 86 and the second screw 87 are rotatably disposed and supported in the first feeding path 79*a* and the second feeding path 79*b*, respectively.

Specifically, as shown in FIG. 14, an end portion of the first screw 86 in a drive-connecting portion side is inserted into a hole 74*a* of the screw cover 74, and the other end portion thereof is inserted into a hole (not shown) provided in the cleaning frame 71. The second screw 87 supports the end portion of the first screw 86 in the drive-connecting portion side by a supporting portion provided on the screw cover 74 as described later, and supports the other end portion by bearings (not shown) provided to the cleaning frame 71 and the cover member 72.

As shown in FIG. 1, the first screw 86 as a first feeding member includes a driving shaft 86*b*1, a drive transmitting portion 86*a*, and a helical blade 86*g* as a feeding portion for feeding the developer, and is provided in the first feeding path 79*a*. The second screw 87 includes a driven shaft 87*b*1 as a rotation shaft, a drive receiving portion 87*a* for receiving the driving force from the drive transmitting portion 86*a*, and a helical blade 87*c* as a feeding portion for feeding the developer, and is provided in the second feeding path 79*b*.

Figure 15:
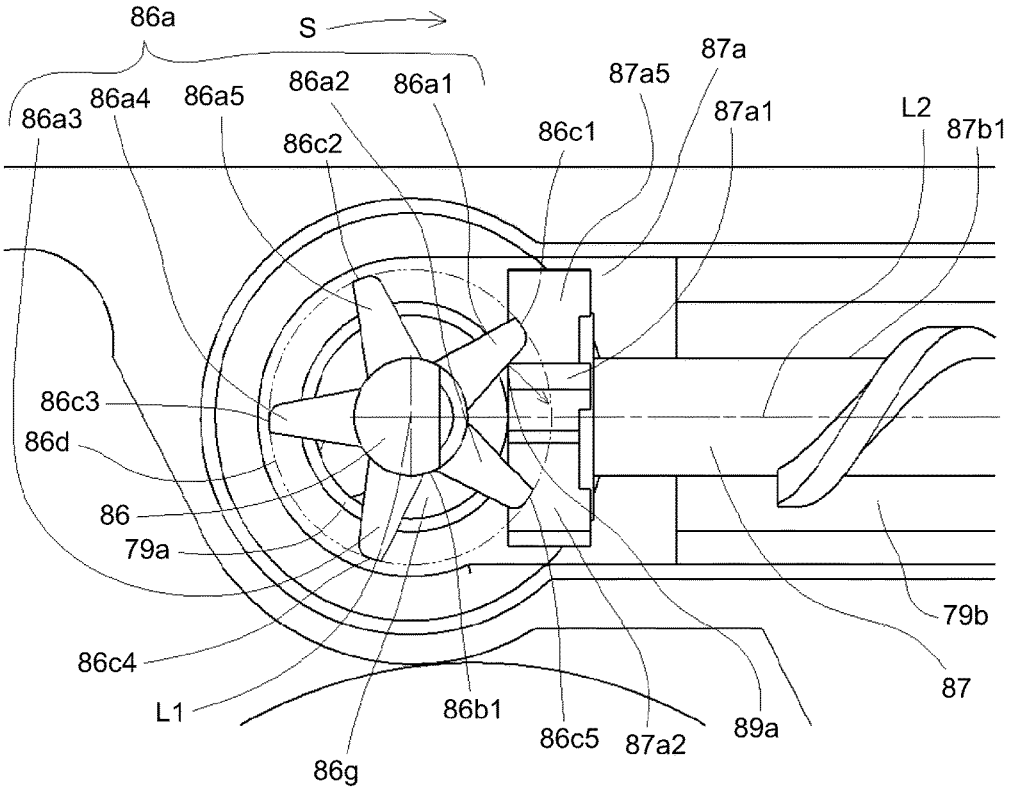
FIG. 15 is a schematic view of the drive-connecting portion between the first screw and the second screw in the feeding device in the First Embodiment as seen in an axial direction of the first screw.

As shown in FIG. 15, the drive transmitting portion 86*a* is constituted by 5 engaging blades 86*a*1-86*a*5 as engaging portions projecting from the driving shaft 86*b*1. The drive receiving portion 87*a* is constituted by 5 blades-to-be-engaged 87*a*1-87*a*5 as portions-to-be-engaged projecting from the driven shaft 87*b*1. However, each of the number of the engaging blades 86*a*1-86*a*5 and the number of the blades-to-be-engaged 87*a*1-87*a*5 is not limited to 5. It is only required that at least one engaging blade 86*a* and two or more blades-to-be-engaged 87*a* are provided and that the driving force can be transmitted.

Further, as shown in FIG. 15, as seen in the direction of the first axis L1 (corresponding to the rotational axis direction of the drive transmitting portion 86*a*), the first screw 86 and the second screw 87 are disposed as described below. That is, the first screw 86 and the second screw 87 are disposed so that a circle 86*d* drawn by a locus of rotation of engaging blade free ends 86*c*1-86*c*5 (maximum projected portions of the drive transmitting portion 86*a* in a radial direction) of the first screw 86 and the second axis L2 of the second screw 87 cross each other.

As shown in FIG. 14, a D-cut surface 86*e* as an inputting portion of the first screw 86 passes through the hole 74*a* provided in the screw cover 74 and projects to an outside of the residual toner accommodating container 75, so that the D-cut surface 86*e* connects with an unshown gear. As a result, the first screw 86 rotates in the first feeding path 79*a*. Further, a sponge-shaped sealing member (not shown) is provided in a gap between the first screw 86 and the hole 74*a*, and an elastomer-shaped sealing member (not shown) is provided in a gap between the cleaning frame 71 and the screw cover 74. As a result, toner leakage from the first feeding path 79*a* and the second feeding path 79*b* to an outside is prevented.

Further, the engaging blades 86*a*1-86*a*5 repeat engagement with and spacing from the blades-to-be-engaged 87*a*1-87*a*5, and thus delivers the residual toner while transmitting the driving force of the first screw to the second screw 87. Further, the second screw 87 transmits the driving force to the third screw 88 in the residual toner chamber 71*b* and delivers the residual toner to the third screw 88 while rotating.

Further, in FIG. 1, in a crossing region between the first feeding path 79*a* and the second feeding path 79*b*, at least a part of the toner is fed in the arrow Y direction by the drive transmitting portion 86*a*, and at least a part of the toner is pushed out in the arrow Y direction by receiving pressure of the toner feeding by the helical blade 86*g*. As a result, the toner is delivered to the second screw 87. Further, as shown in FIG. 14, the supporting portion for rotatably supporting the end portion of the second screw in the drive-connecting portion side is provided to the cleaning frame 71 or the screw cover 74.

In this embodiment, as shown in (a) and (b) of FIG. 1, the cleaning frame 71 is provided with a first bearing portion 71 *l* as a bearing portion for preventing movement of the second screw 87 in the direction of the first axis L1. Further, as shown in (b) of FIG. 1, the cleaning frame 71 is provided with a second bearing portion 71*m* and a third bearing portion 71*n* which are used for preventing movement of the second screw 87 in the direction of the third axis L3. Further, the cleaning frame 71 is provided with a first preventing portion 71*q* for preventing movement of the second screw 87 in the direction of the second axis L2. Further, in this embodiment, as shown in FIG. 1, as seen in the direction of the third axis L3, with respect to the second axis L2, the drive transmitting portion 86*a* was disposed in one side and the first bearing portion 71*l* was disposed only in the other side.

By the above-described arrangement, when the engaging blades 86*a*1-86*a*5 and the blades-to-be-engaged 87*a*1-87*a*5 engage with each other, the second screw 87 is likely to move in a J direction in FIG. 1. That is, as seen in the direction of the third axis L3, with respect to the second axis L2, the second screw 87 is likely to move in the J direction from a side where the drive transmitting portion 86*a* is disposed toward a side where the first bearing portion 71*l* is disposed. However, movement of the second screw 87 in the J direction is prevented by the first bearing portion 71*l*. At this time, the prevention of the movement of the second screw 87 in the direction of the first axis L1 caused by the transmission of the driving force may only be made with respect to the J direction.

Thus, in this embodiment, as seen in the direction of the third axis L3 in a plane crossing the second axis L2, there is an urging direction (J direction) in which the second screw 87 is urged by the driving force from the drive transmitting portion 86*a*. Further, the bearing portion 71*l* generates reaction having a component exerting in a direction opposite to the urging direction, so that the bearing portion 71*l* rotatably supports the second screw 87.

In this embodiment, prevention of the movement of the second screw 87 in the direction of the first axis L1 can be made by the first bearing portion 71*l*. For that reason, there is no need to dispose the bearing in the neighborhood of a side downstream of the drive transmitting portion 86*a* in a side where the drive transmitting portion 86*a* is disposed in the second feeding path 79*b* with respect to the second axis L2. Therefore, it is possible to suppress a degree of inhibition of the toner (developer) fed by the drive transmitting portion 86*a* in the arrow Y direction by the bearing itself which rotatably supports the end portion of the second screw 87 in the drive-connecting portion side. By the above-described effect, a toner feeding property can be improved.

Second Embodiment

The Second Embodiment of the present invention will be described. In this embodiment, portions (drive transmitting portion and developer feeding portion) different from those in First Embodiment will be described in detail. Unless otherwise specified, materials, shapes and the like of portions are similar to those in the First Embodiment. The portions are represented by the same reference numerals or symbols and will be omitted from detailed description.

Figure 16:
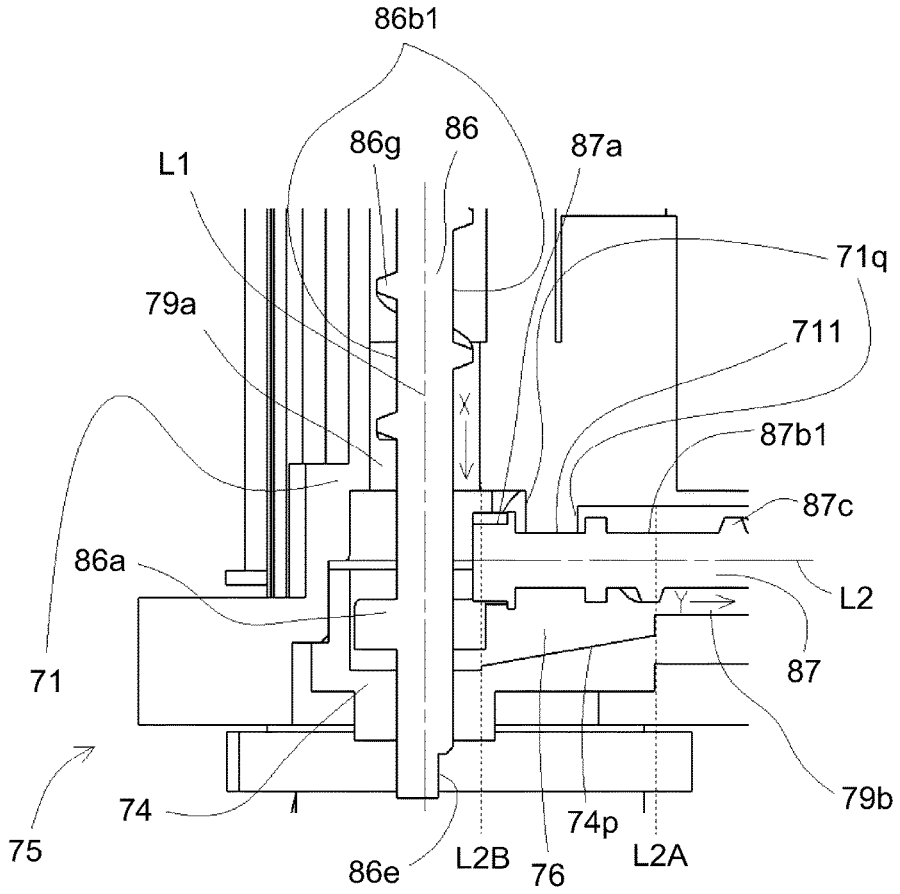
FIG. 16 is a sectional view of a first feeding path and a second feeding path in a feeding device according to a Second Embodiment to which the present invention is applicable.

In this embodiment, as shown in FIG. 16, as seen in the direction of the third axis L3, the second feeding path 79*b* includes an enlarged portion (path) 76 where the feeding path is enlarged in the neighborhood of the first feeding path 79*a*. As seen in the direction of the third axis L3, of the enlarged portion 76, a most downstream position of the second feeding path 79*b* with respect to the direction of the second axis L2 is a first position, and a position where the second feeding path 79*b* connects with the first feeding path 79*a* with respect to the direction of the second axis L2 is a second position L2B. As seen in the direction of the third axis L3, the screw cover 74 has a first wall surface 74*p* between the upstream second position L2B where the drive transmitting portion 86*a* is provided and the downstream first position L2A with respect to the direction of the second axis L2.

The first wall position 74*p* is disposed so that the second feeding path 79*b* is larger at the second position L2B than at the first position L2A as seen in the direction of the third axis L3. That is, the first wall surface 74*p* has a shape such that a distance of the first wall surface 74*p* from the second axis L2 increases at the upstream second position more than at the downstream first position with respect to the developer feeding direction.

In this embodiment, in addition to the effect (of suppressing the degree of the inhibition by the bearing itself) of the First Embodiment, the toner feeding can be made in the larger path having the first wall surface 74*p*, so that the toner feeding property can be further improved.

Third Embodiment

The Third Embodiment of the present invention will be described with reference to FIG. 17. In this embodiment, portions (drive transmitting portion and developer feeding portion) different from those in the First Embodiment will be described in detail. Unless otherwise specified, materials, shapes and the like of portions are similar to those in the First Embodiment. The portions are represented by the same reference numerals or symbols and will be omitted from detailed description.

Figure 17:
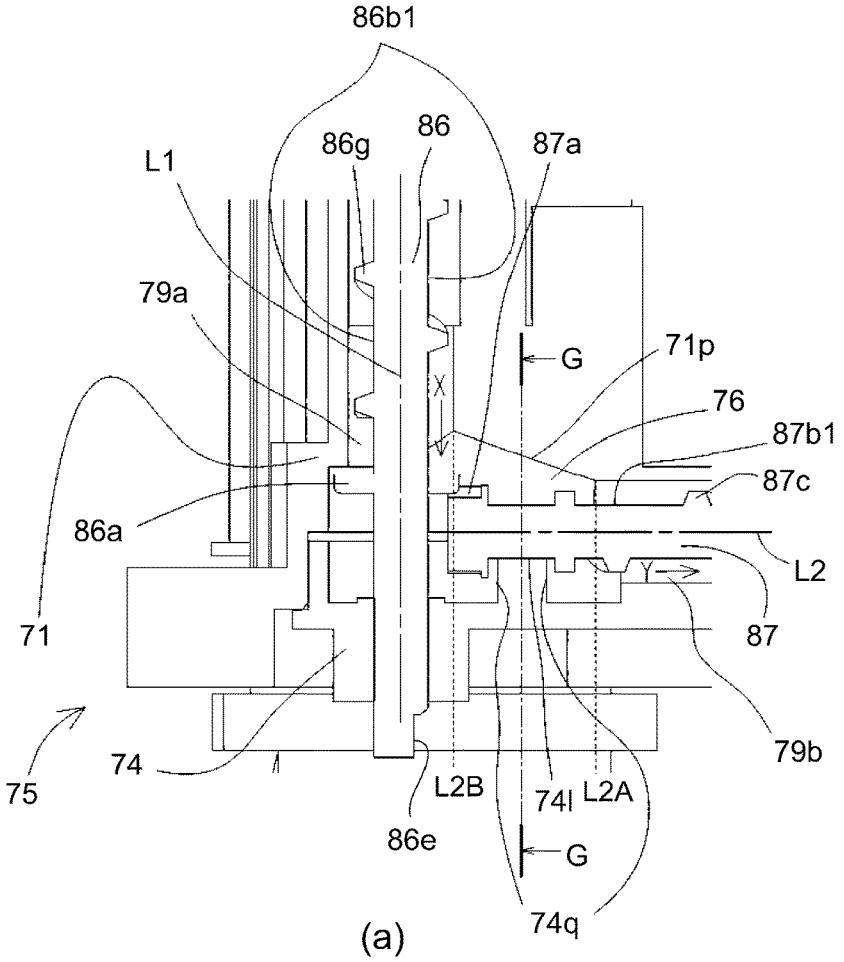
In FIG. 17, (a) and (b) are sectional views each showing a first feeding path and a second feeding path in a feeding device according to a Third Embodiment to which the present invention is applicable.
Figure 17:
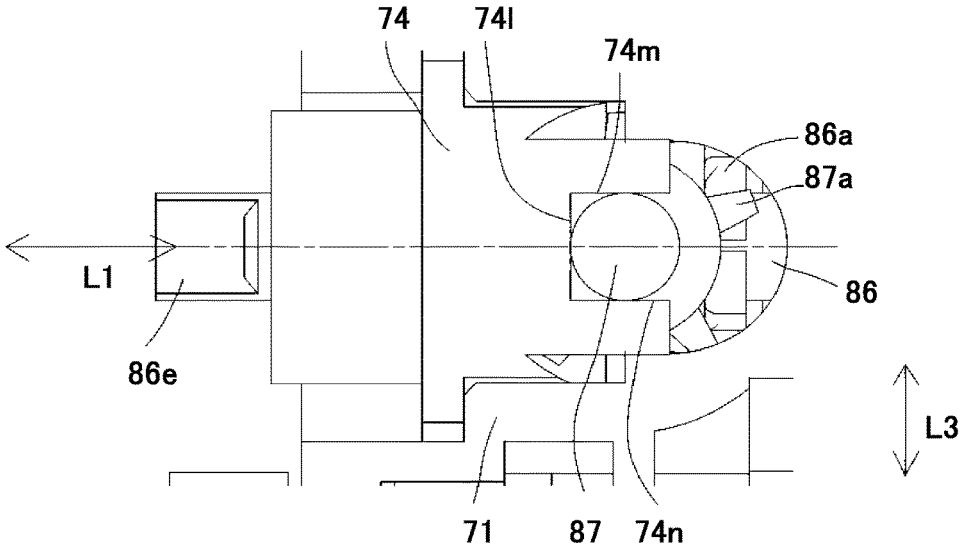

In this embodiment, as shown in FIG. 17, as seen in the direction of the third axis L3, with respect to the second axis L2, the drive transmitting portion 86*a* is provided in a region upstream of the first screw 86 with respect to the feeding direction X.

Further, in this embodiment, the screw cover 74 is provided with the first bearing portion 74*l*, as a bearing portion for preventing movement of the second screw 87 in the direction of the first axis L1, only in a side opposite from the side where the drive transmitting portion 86*a* is provided with respect to the second axis L2. Further, the screw cover 74 is provided with a second bearing portion 74*m* and a third bearing portion 74*n* which are used for preventing movement of the second screw 87 in the direction of the third axis L3 and is provided with a first preventing portion 74*q* for preventing movement of the second screw 87 in the direction of the second axis L2.

Further, as seen in the direction of the third axis L3, the cleaning frame 71 has a first wall surface 71*p* between the downstream first position L2A and the upstream second position L2B with respect to the developer feeding direction in a side where the drive transmitting portion 86*a* is provided with respect to the second axis L2.

By employing the above-described constitution, the toner can be delivered from the first screw 86 to the second screw 87 along a shorter path, so that the toner feeding property can be further improved.

Fourth Embodiment

The Fourth Embodiment of the present invention will be described. In this embodiment, portions (drive transmitting portion and developer feeding portion) different from those in the Third Embodiment will be described in detail. Unless otherwise specified, materials, shapes and the like of portions are similar to those in the Third Embodiment. The portions are represented by the same reference numerals or symbols and will be omitted from detailed description.

Figure 18:
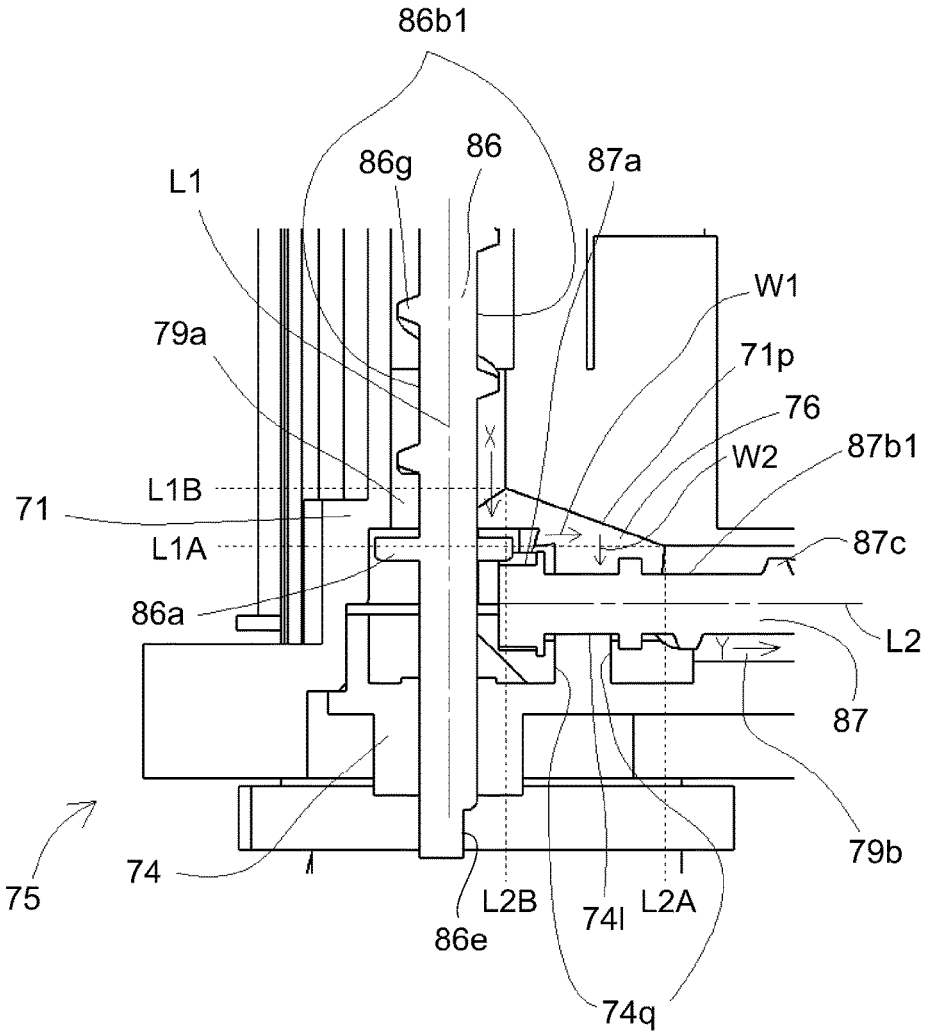
FIG. 18 is a sectional view showing a first feeding path and a second feeding path in a feeding device according to a Fourth Embodiment to which the present invention is applicable.

In this embodiment, regions (positions) of the first wall surface 71*p* and the drive transmitting portion 86*a* at least partly overlap with each other with respect to the direction of the first axis L1, and regions (positions) of the first wall surface 71*p* and the first bearing portion 74*l* at least partly overlap with each other with respect to the direction of the second axis L2. That is, in FIG. 18, as seen in the direction of the third axis L3, with regard to the enlarge path (portion) 76, when a most downstream position with respect to the direction of the first axis L1 is a third position L1A and a position where the second feeding path 79*b* connects with the first feeding path 79*a* with respect to the direction of the first axis L1 is a fourth position L1B, the following constitution is employed.

In this embodiment, the enlarged path 76 is provided not only between the first position L2A and the second position L2B but also between the third position L1A and the fourth position L1B. Further, at least a part of the first bearing portion 74*l* is disposed between the first position L2A and the second position L2B, and at least a part of the drive transmitting portion 86*a* is disposed between the third position L1A and the fourth position L1B. That is, the regions (positions) of the drive transmitting portion 86*a* and the first wall surface 71*p* at least partly overlap with each other with respect to the direction of the first axis L1, and the regions (positions) of the first bearing portion 74*l* and the first wall surface 71*p* at least partly overlap with each other with respect to the direction of the second axis L2.

By employing the above-described constitution, at least one of the toner fed in the arrow Y direction by the drive transmitting portion 86*a* and the toner fed in the arrow Y direction by receiving the toner feeding force of the helical blade 86*g* applies a force W1 to the toner in the neighborhood of the first wall surface 71*p*. The toner which received the force W1 applies a force W1 to the second screw W1 in the direction of the first axis L1 through the first wall surface 71*p*. The second screw 87 is pressed against the first bearing portion 74*l* by receiving the force W1 from the toner, so that movement of the second screw 87 in the direction of the first axis L1 is suppressed, and thus a position of a rotational axis of the second screw 87 can be stabilized.

As a result, smooth drive transmission can be realized, so that effects of improving the toner feeding property, reducing a loss of a torque, and preventing noise can be expected.

MODIFIED EMBODIMENTS

Preferred embodiments of the present invention were described above, but the present invention is not limited thereto. Various modifications and changes of constitutions of the present invention are possible within the scope of the present invention. Incidentally, with respect to functions, materials, shapes and relative arrangement of constituent elements described in the above embodiments, the scope of the present invention is not intended to be limited only to these parameters.

Modified Embodiment 1

In the above-described embodiments, as seen in the direction of the third axis L3 perpendicular to each of the direction of the first axis L1 and the direction of the second axis L2, with respect to the second axis L2, the drive transmitting portion 86*a* is disposed in one side and the bearing portion 71*l* is disposed only in the other side, but the present invention is not limited thereto. As seen in the direction of the third axis L3 perpendicular to each of the direction of the first axis L1 and the direction of the second axis L2, with respect to the second axis L2, the drive transmitting portion 86*a* is disposed in one side and the bearing portion 71*l* may also be disposed in each of the other side and the one side.

Modified Embodiment 2

The present invention having the constitutes relating to the screw members described in the above-described embodiments is not limited to those for feeding the residual toner, but may also be used for feeding the developer in the developing device.

Modified Embodiment 3

In the above-described embodiments, description that the number of each of the engaging blades and the blades-to-be-engaged 5 was made, but the number of the associated blades is not limited to 5. It is only required that at least one engaging blade and two or more (a plurality of) blades-to-be-engaged are used and that the driving force can be transmitted. Further, in the above-described embodiments, the shape of the screw was described using the twisted shape, but may also be a bevel gear shape.

Modified Embodiment 4

In the above-described embodiments, as the developer feeding member, the mechanism using the first screw 86 and the second screw 87 was described, but the developer feeding member is not limited to the screw. For example, the developer feeding member may also be a flexible sheet provided on a rotation shaft so as to feed the developer in a radial direction.

Modified Embodiment 5

In the above-described embodiments, the feeding device for feeding the developer is provided in the process cartridge insertable into the apparatus main assembly of the image forming apparatus, but may also be provided in an apparatus main assembly of an image forming apparatus in which the process cartridge is not used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-202503 filed on Oct. 14, 2015, which is hereby incorporated by reference herein in its entirety.

What is claimed is:

1. A feeding device for feeding developer along a first feeding path and a second feeding path, comprising:

a first feeding member rotatable around a first rotational axis extended in a first direction and for feeding the developer in a feeding direction along the first direction, said first feeding member being provided in the first feeding path and including a drive transmitting portion;

a second feeding member rotatable around a second rotational axis extended in a second direction crossing the first direction and for feeding the developer along the second direction, and said second feeding member being provided in the second feeding path and including a drive receiving portion and a helical blade as a feeding portion; and a bearing portion for rotatably supporting said second feeding member, said bearing portion being configured to support said second feeding member in a portion between said drive receiving portion and said helical blade, wherein said drive transmitting portion and said drive receiving portion engage with each other so as to enable delivery of the developer from said first feeding member to said second feeding member while transmitting a driving force of said first feeding member to said second feeding member, and wherein said bearing portion is provided on one side of the second rotational axis with respect to the feeding direction.

2. A feeding device according to claim 1, wherein said bearing portion includes a first portion for preventing movement of said second feeding member in the first direction, and wherein said first portion is disposed only on an upstream side of said second rotational axis in the feeding direction.

3. A feeding device according to claim 2, wherein a wall surface crossing each of the first direction and the second direction is provided so that a distance between said first feeding member and said wall surface is shorter in a downstream side than in the upstream side with respect to the feeding direction.

4. A feeding device according to claim 3, wherein with respect to the second direction, the position of said wall surface and a position of said bearing portion at least partly overlap with each other.

5. A feeding device according to claim 3, wherein with respect to the first direction, the position of said wall surface and a position of said drive transmitting portion at least partly overlap with each other.

6. A feeding device according to claim 1, wherein said first feeding member includes a first helical blade as a feeding portion and a first shaft.

7. A feeding device according to claim 6, wherein said drive transmitting portion includes engaging blades projecting from said first shaft toward a direction crossing the first direction.

8. A feeding device according to claim 1, wherein said bearing portion includes a first portion for preventing movement of said second feeding member in the first direction, and wherein said first portion is disposed only on a downstream side of the second rotational axis in the feeding direction, wherein a wall surface crossing each of the first direction of the first rotational axis and the second direction of the second rotational axis is provided so that a distance between said first feeding member and said wall surface is longer in the downstream side than in an upstream side with respect to the feeding direction.

9. A feeding device according to claim 8, wherein said first feeding member includes a first helical blade as a feeding portion and a first shaft.

10. A feeding device according to claim 9, wherein said drive transmitting portion includes engaging blades projecting from said first shaft toward a direction crossing the first direction.

11. A feeding device according to claim 8, wherein with respect to the second direction, a position of said wall surface and a position of said bearing portion at least partly overlap with each other.

12. A feeding device according to claim 11, wherein with respect to the first direction, the position of said wall surface and a position of said drive transmitting portion at least partly overlap with each other.

13. A cartridge comprising:

a photosensitive member; and said feeding device according to claim 1, wherein said first feeding member and said second feeding member are configured to feed residual developer removed from said photosensitive member.

14. A feeding device for feeding developer along a first feeding path and a second feeding path, comprising:

a first feeding member rotatable around a first rotational axis extended in a first direction and for feeding the developer along the first direction, said first feeding member being provided in the first feeding path and including a drive transmitting portion;

a second feeding member rotatable around a second rotational axis extended in a second direction crossing the first direction and for feeding the developer along the second direction, said second feeding member being provided in the second feeding path and including a drive receiving portion and a helical blade as a feeding portion, and a bearing portion for rotatably supporting said second feeding member, said bearing portion being configured to support said second feeding member in a portion between said drive receiving portion and said helical blade, wherein said drive transmitting portion and said drive receiving portion engage with each other so as to enable delivery of the developer from said first feeding member to said second feeding member while transmitting a driving force of said first feeding member to said second feeding member, and wherein as seen in a third direction perpendicular to each of the first rotational axis and the second rotational axis, said drive transmitting portion and said drive receiving portion engage with each other on one side of the second rotational axis, and said bearing portion is disposed on the other side of the second rotational axis with respect to the first direction.

15. A feeding device according to claim 14, wherein said first feeding member feeds the developer in a feeding direction along the first direction, wherein said bearing portion includes a first portion for preventing movement of said second feeding member in the first direction, and wherein said first portion is disposed in a downstream side of said second rotational axis with respect to the feeding direction.

16. A feeding device according to claim 14, further comprising a wall surface crossing each of the first direction and the second direction.

17. A feeding device according to claim 16, wherein said first feeding member feeds the developer in a feeding direction along the first direction, and wherein said bearing portion includes a first portion for preventing movement of said second feeding member in the first direction, said first portion disposed in a downstream side of the second rotational axis with respect to the feeding direction, and the wall surface is disposed in an upstream side of the second rotational axis with respect to the feeding direction.

18. A feeding device according to claim 17, wherein with respect to the second direction, a position of the wall surface and a position of said bearing portion at least partly overlap with each other.

19. A feeding device according to claim 18, wherein with respect to the first direction, the position of the wall surface and a position of said drive transmitting portion at least partly overlap with each other.

20. A feeding device according to claim 14, wherein with respect to a feeding direction of said second feeding member, said drive transmitting portion and said drive receiving portion engage with each other in a downstream side of the first rotational axis.

21. A cartridge comprising:

a photosensitive member; and the feeding device according to claim 14, wherein the first feeding member and the second feeding member are configured to feed residual developer removed from said photosensitive member.

* * * * *